US007159577B2

(12) United States Patent
Haskew et al.

(10) Patent No.: US 7,159,577 B2
(45) Date of Patent: Jan. 9, 2007

(54) STATIONARY EVAPORATIVE EMISSION CONTROL SYSTEM

(75) Inventors: Harold Milton Haskew, 3760 Old Plank Rd., Milford, MI (US) 48381; Peter D. Shears, Wauwatosa, WI (US)

(73) Assignees: Briggs and Stratton Corporation, Wauwatosa, WI (US); Harold Milton Haskew, Milford, MI (US)

( * ) Notice: Subject to any disclaimer, the term of this patent is extended or adjusted under 35 U.S.C. 154(b) by 0 days.

(21) Appl. No.: 11/259,803

(22) Filed: Oct. 27, 2005

(65) Prior Publication Data

US 2006/0042604 A1 Mar. 2, 2006

Related U.S. Application Data

(62) Division of application No. 10/411,477, filed on Apr. 10, 2003, now Pat. No. 6,959,696.

(60) Provisional application No. 60/372,268, filed on Apr. 12, 2002.

(51) Int. Cl.
*F02M 55/02* (2006.01)

(52) U.S. Cl. ..... 123/516; 123/518

(58) Field of Classification Search ..... 123/516–520
See application file for complete search history.

(56) References Cited

U.S. PATENT DOCUMENTS

| | | | |
|---|---|---|---|
| 1,499,864 | A | 7/1924 | Gordon |
| 2,358,840 | A | 9/1944 | Walker |
| 2,520,124 | A | 8/1950 | Chaney et al. |
| 2,553,763 | A | 5/1951 | Hammon |
| 2,822,059 | A | 2/1958 | Lunn et al. |
| 2,966,960 | A | 1/1961 | Rochlin |
| 3,221,724 | A | 12/1965 | Wentworth |
| 3,352,294 | A | 11/1967 | Biller et al. |
| 3,368,326 | A | 2/1968 | Hervert |
| 3,372,679 | A | 3/1968 | Aitken |
| 3,391,679 | A | 7/1968 | Williams et al. |
| 3,406,501 | A | 10/1968 | Watkins |
| 3,456,635 | A | 7/1969 | Hervert |
| 3,477,210 | A | 11/1969 | Hervert |
| 3,541,765 | A | 11/1970 | Adler et al. |
| 3,572,013 | A | 3/1971 | Hansen |
| 3,572,014 | A | 3/1971 | Hansen |
| 3,610,220 | A | 10/1971 | Yamada |
| 3,610,221 | A | 10/1971 | Stoltman |
| 3,617,034 | A | 11/1971 | Skinner |
| 3,645,244 | A | 2/1972 | Seyfarth |
| 3,646,731 | A | 3/1972 | Hansen |
| 3,650,256 | A | 3/1972 | Marshall |
| 3,665,906 | A | 5/1972 | De Palma |

(Continued)

FOREIGN PATENT DOCUMENTS

| | | |
|---|---|---|
| DE | 4304180 | 8/1993 |

(Continued)

OTHER PUBLICATIONS

George A. Lavoie et al., "A Fuel Vapor Model (FVSMOD) for Evaporative Emissions System Design and Analysis," 1998 Society of Automotive Engineers, Inc.

(Continued)

*Primary Examiner*—Thomas Moulis
(74) *Attorney, Agent, or Firm*—Michael Best & Friedrich LLP

(57) ABSTRACT

A stationary fuel storage system that includes a stationary fuel tank that defines a tank volume adapted to store a quantity of fuel. An evaporative emission device is disposed outside of the tank volume and defines a device volume that is in fluid communication with the atmosphere. A mass of fuel vapor adsorbing material is disposed within the device volume and a vent conduit provides fluid communication between the fuel tank and the evaporative emission device.

24 Claims, 10 Drawing Sheets

U.S. PATENT DOCUMENTS 3,675,634 A 7/1972 Tatsutomi et al.
3,678,663 A 7/1972 Hansen
3,681,899 A 8/1972 Grote
3,696,799 A 10/1972 Gauck
3,721,072 A 3/1973 Clapham
3,747,303 A 7/1973 Jordan
3,757,753 A 9/1973 Hunt
3,759,234 A 9/1973 Buckton et al.
3,831,353 A * 8/1974 Toth ..... 96/144
3,849,093 A 11/1974 Konishi et al.
3,913,545 A 10/1975 Haase et al.
3,990,419 A 11/1976 Itakura
4,112,898 A 9/1978 Takimoto et al.
4,127,097 A 11/1978 Takimoto
4,175,526 A 11/1979 Phelan
4,259,096 A 3/1981 Nakamura et al.
4,261,717 A 4/1981 Belore et al.
4,279,233 A 7/1981 Tobita et al.
4,279,630 A 7/1981 Nakamura et al.
4,280,360 A 7/1981 Kobayashi et al.
4,375,204 A 3/1983 Yamamoto
4,415,344 A 11/1983 Frost et al.
4,418,662 A 12/1983 Engler et al.
4,446,838 A 5/1984 Suzuki et al.
4,475,522 A 10/1984 Oonaka
4,629,479 A 12/1986 Cantoni
4,631,077 A 12/1986 Spicer et al.
4,631,952 A 12/1986 Donaghey
4,658,795 A 4/1987 Kawashima et al.
4,684,382 A 8/1987 Abu-Isa
4,684,510 A 8/1987 Harkins
4,690,293 A * 9/1987 Uranishi et al. ..... 220/86.2
4,705,007 A 11/1987 Plapp et al.
4,747,388 A 5/1988 Tuckey
4,758,460 A 7/1988 Spicer et al.
4,852,761 A 8/1989 Turner et al.
4,919,103 A 4/1990 Ishiguro et al.
4,938,787 A 7/1990 Simmerlein-Erlbacher
5,215,132 A 6/1993 Kobayashi
5,221,573 A 6/1993 Baigas, Jr.
5,226,397 A 7/1993 Zabeck et al.
5,259,412 A * 11/1993 Scott et al. ..... 137/588
5,261,439 A 11/1993 Harris
5,280,814 A * 1/1994 Stroh ..... 141/83
5,301,829 A 4/1994 Chrisco
5,313,977 A 5/1994 Bergsma et al.
5,313,978 A 5/1994 Takaki
5,326,514 A 7/1994 Linden et al.
5,338,253 A 8/1994 Damsohn et al.
5,350,444 A 9/1994 Gould et al.
5,408,977 A 4/1995 Cotton
5,424,036 A 6/1995 Ushikubo
5,437,701 A 8/1995 Townsley
5,453,118 A 9/1995 Heiligman
5,478,379 A 12/1995 Bevins
5,499,613 A * 3/1996 Bayerle et al. ..... 123/520
5,560,345 A 10/1996 Geyer et al.
5,562,084 A 10/1996 Shimamura
5,566,705 A 10/1996 Harris
5,573,811 A 11/1996 Townsley
5,623,911 A 4/1997 Kiyomiya et al.
5,638,786 A 6/1997 Gimby
5,687,778 A * 11/1997 Harris ..... 141/59
5,704,337 A 1/1998 Stratz et al.
5,727,531 A 3/1998 Osanai
5,762,692 A 6/1998 Dumas et al.
5,798,270 A 8/1998 Adamczyk, Jr. et al.
5,809,976 A 9/1998 Cook
5,871,569 A 2/1999 Oehler et al.
5,875,768 A 3/1999 Schenk et al.
5,878,729 A 3/1999 Covert et al.
5,891,207 A 4/1999 Katta
5,898,107 A 4/1999 Schenk
5,901,689 A 5/1999 Kimura et al.
5,912,368 A 6/1999 Satarino et al.
5,935,398 A 8/1999 Taniguchi et al.
5,957,114 A 9/1999 Johnson et al.
6,102,085 A 8/2000 Nanaji
6,105,708 A 8/2000 Amano et al.
6,136,075 A 10/2000 Bragg et al.
6,152,996 A 11/2000 Linnersten et al.
6,156,089 A 12/2000 Stemmer et al.
6,182,693 B1 2/2001 Stack et al.
6,189,516 B1 2/2001 Hei Ma
6,231,646 B1 5/2001 Schweizer et al.
6,237,754 B1 5/2001 Jamrog et al.
6,269,802 B1 8/2001 Denis et al.
6,273,070 B1 8/2001 Arnal et al.
6,302,144 B1 10/2001 Graham et al.
6,330,879 B1 12/2001 Kitamura et al.
6,354,280 B1 3/2002 Itakura et al.
6,360,729 B1 * 3/2002 Ellsworth ..... 123/518
6,367,458 B1 4/2002 Furusho et al.
6,390,074 B1 5/2002 Rothamel et al.
6,395,048 B1 5/2002 Yoder et al.
6,463,915 B1 10/2002 Ozaki et al.
6,464,761 B1 10/2002 Bugli
6,505,610 B1 1/2003 Everingham et al.
6,591,866 B1 7/2003 Distelhoff et al.
6,595,167 B1 7/2003 Kaesgen
6,675,780 B1 1/2004 Wendels et al.
6,692,551 B1 2/2004 Wernholm et al.
6,692,555 B1 2/2004 Oda et al.
6,699,310 B1 3/2004 Oda et al.
6,729,312 B1 5/2004 Furushou
6,729,319 B1 5/2004 Mitsutani
6,736,871 B1 5/2004 Green et al.
6,750,556 B1 * 6/2004 Sodemann et al. ..... 290/1 A
6,758,885 B1 7/2004 Leffel et al.
6,772,740 B1 8/2004 Kojima et al.
6,779,512 B1 8/2004 Mitsutani
6,786,207 B1 9/2004 Kojima et al.
6,863,082 B1 2/2005 McIntosh et al.
6,874,484 B1 4/2005 Benjey
6,874,485 B1 4/2005 Fujimoto
6,877,488 B1 4/2005 Washeleski
6,892,711 B1 5/2005 Belanger, Jr. et al.
6,928,990 B1 * 8/2005 Meiller et al. ..... 123/519
6,959,696 B1 11/2005 Shears et al.
6,976,477 B1 12/2005 Gimby et al.
2005/0005917 A1 1/2005 Veinotte
2005/0072221 A1 * 4/2005 Itakura et al. ..... 73/118.1
2005/0178368 A1 8/2005 Donahue et al.
2005/0284450 A1 12/2005 Mills

FOREIGN PATENT DOCUMENTS

EP 0 611896 8/1994
EP 1110593 6/2001
GB 2082935 3/1992
JP 54141916 11/1979
JP 58-067960 4/1983

OTHER PUBLICATIONS

H. Bauer.-ed., "Gasoline-Engine Management," 1999, p. 152, Robert Bosch GmbH.
H. Bauer.-ed., "Gasoline Engine Management," 1999, p. 288-289, Robert Bosch GmbH.
H. Bauer.-ed., "Gasoline Engine Management," 1999, pp. 343-345, Robert Bosch GmbH.
"Automotive Fuel Lines," Verlag Moderne Industie, 1998, p. 4.

* cited by examiner

12F

14a

14b

STATIONARY EVAPORATIVE EMISSION CONTROL SYSTEM

This application is a divisional of patent application Ser. No. 10/411,477 filed on Apr. 10, 2003, now U.S. Pat. No. 6,959,696 which claims the benefit of prior filed co-pending provisional patent application No. 60/372,268 filed on Apr. 12, 2002, both of which are incorporated by reference herein.

FIELD OF THE INVENTION

The invention relates to internal combustion engine emission control, and more particularly to control of fuel evaporative emissions utilizing a control device containing activated carbon.

BACKGROUND INFORMATION

Fuel tanks are often employed to provide fuel to engines, such as internal combustion engines, diesel engines, combustion engines, and the like. In many cases, the fuel tanks, as well as the engines, are mobile. For example automobile engines and lawn mower engines include a fuel tank that is permanently attached to and moves with the automobile or the lawn mower.

Other fuel tanks remain stationary and serve to store fuel for use in one or more stationary applications. For example, farms often include a large fuel tank that stores fuel that can be used with vehicles, tractors, lawn equipment, snow equipment, and the like. Another example of a detachable fuel storage tank is a fuel tank used in marine applications. Thus, the fuel tank does not have a permanent connection between it and an engine. Rather, an outlet from the tank allows fuel to be drawn from the tank and delivered to the desired location.

Stationary tanks may be subjected to daily ambient temperature changes that may cause the release of hydrocarbons or gasoline. Such emissions are known as "diurnal" emissions. Fuel tanks are typically vented to the atmosphere to prevent pressure buildup in the tank.

SUMMARY OF THE INVENTION

The invention provides a stationary fuel storage system that includes a stationary fuel tank that defines a tank volume adapted to store a quantity of fuel. An evaporative emission device is disposed outside of the tank volume and defines a device volume that is in fluid communication with the atmosphere. A mass of fuel vapor adsorbing material is disposed within the device volume and a vent conduit provides fluid communication between the fuel tank and the evaporative emission device.

The invention also provides a stationary evaporative emission control system that includes an evaporative emission device having a mass of fuel vapor adsorbing material and a stationary fuel tank having a tank volume. An atmospheric vent provides fluid communication between the evaporative emission device and the atmosphere and a vent conduit provides fluid communication between the fuel tank and the evaporative emission device. The vent conduit enables flow from the fuel tank to the evaporative emission device in response to an increase in pressure within the fuel tank and enables flow from the evaporative emission device to the fuel tank in response to a decrease in pressure within the fuel tank. The device volume and the tank volume are sized relative to one another, and a portion of fuel vapor passing from the evaporative emission device to the atmosphere is substantially reduced.

The invention further provides a stationary fuel storage system that includes a stationary fuel tank that defines a tank volume adapted to store a quantity of fuel and a passive evaporative emission device. A first flow path provides fluid communication between the passive evaporative emission device and the atmosphere. A mass of fuel vapor adsorbing material is disposed within the device volume and a vent conduit provides fluid communication between the fuel tank and the evaporative emission device such that fuel vapor is able to flow between the tank and the evaporative emission device.

The invention also provides a fuel storage system that includes a fuel tank that defines a tank volume adapted to store a quantity of fuel and an evaporative emission device that defines a device volume. A vent aperture provides fluid communication between the fuel tank and the evaporative emission device such that the evaporative emission device is in direct fluid communication with only the atmosphere and the fuel tank.

Other features and advantages of the invention will become apparent to those skilled in the art upon review of the following detailed description and drawings.

Figure 1:
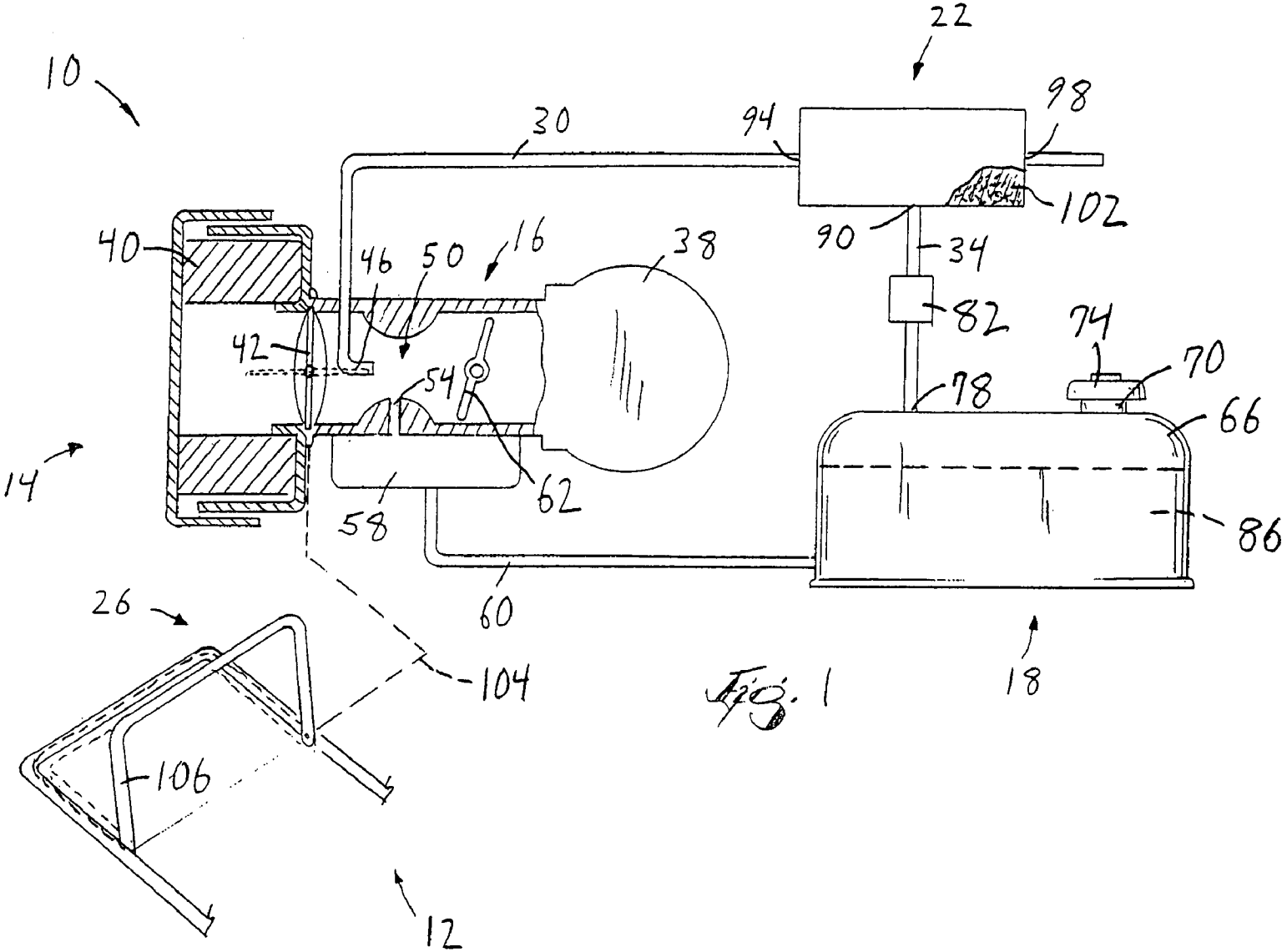
FIG. 1 is a schematic view of an internal-combustion-engine-powered device having a fuel vapor control system embodying the invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

Figure 8:
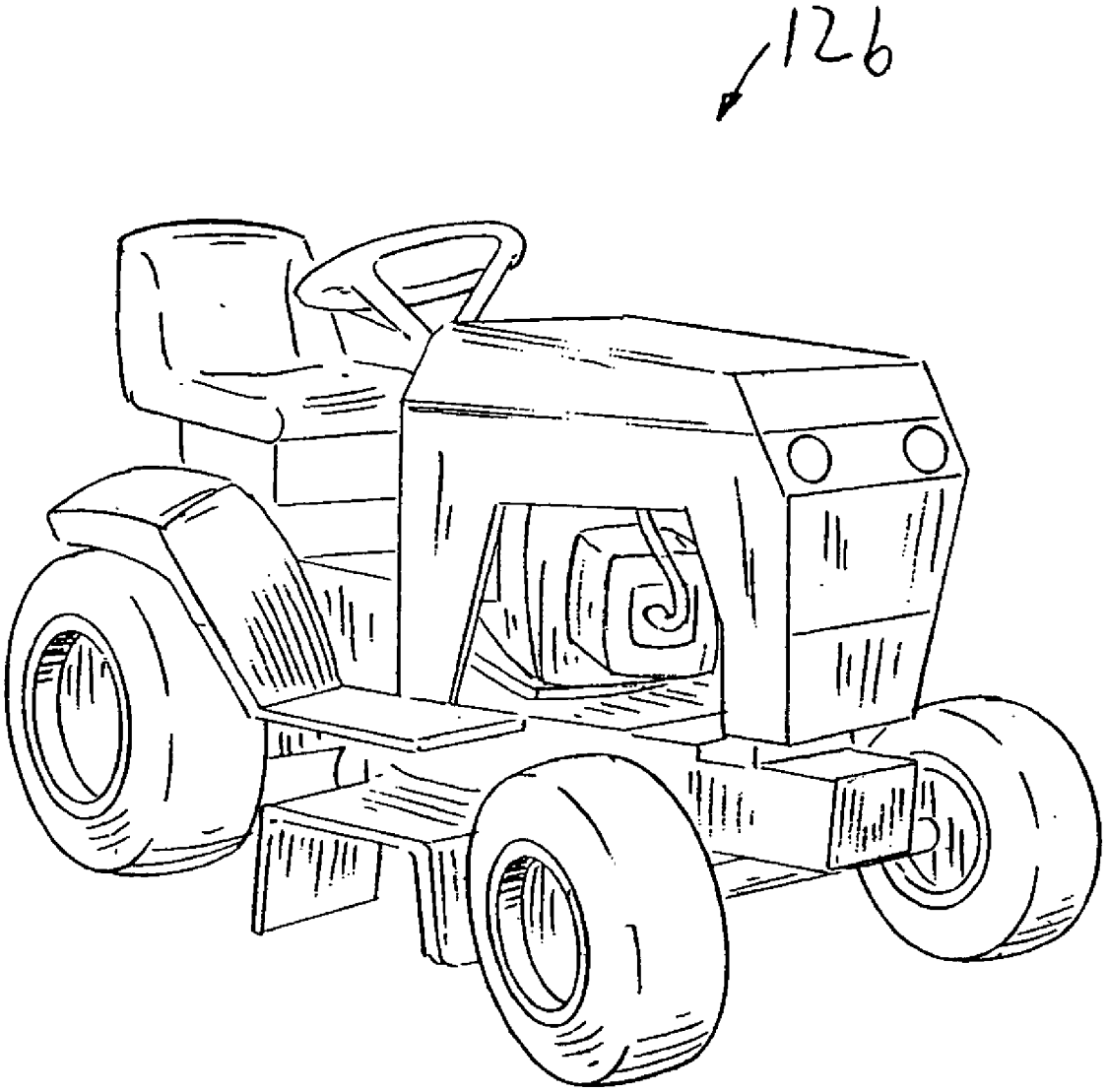
FIG. 8 is a lawn tractor having an internal combustion engine embodying the invention.
Figure 9:
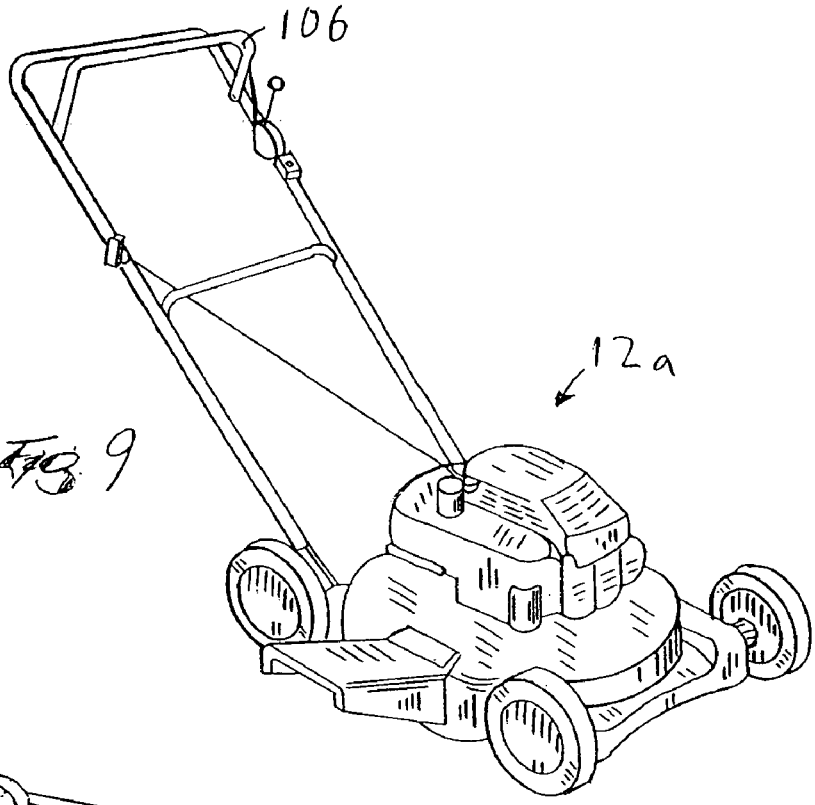
FIG. 9 is a walk-behind lawnmower having an internal combustion engine embodying the invention.
Figure 10:
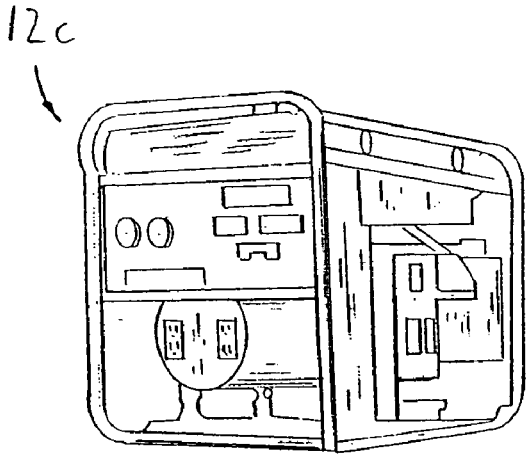
FIG. 10 is a portable generator having an internal combustion engine embodying the invention.
Figure 11:
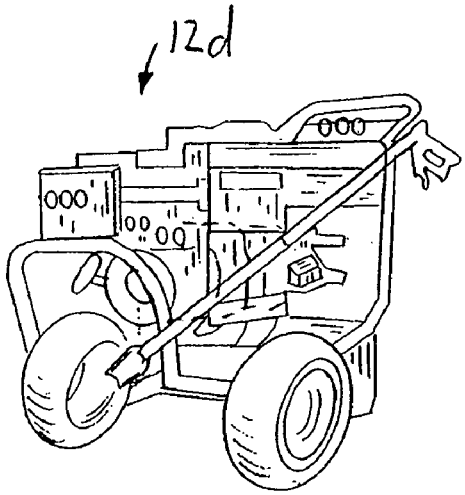
FIG. 11 is a portable pressure washer having an internal combustion engine embodying the invention.
Figure 12:
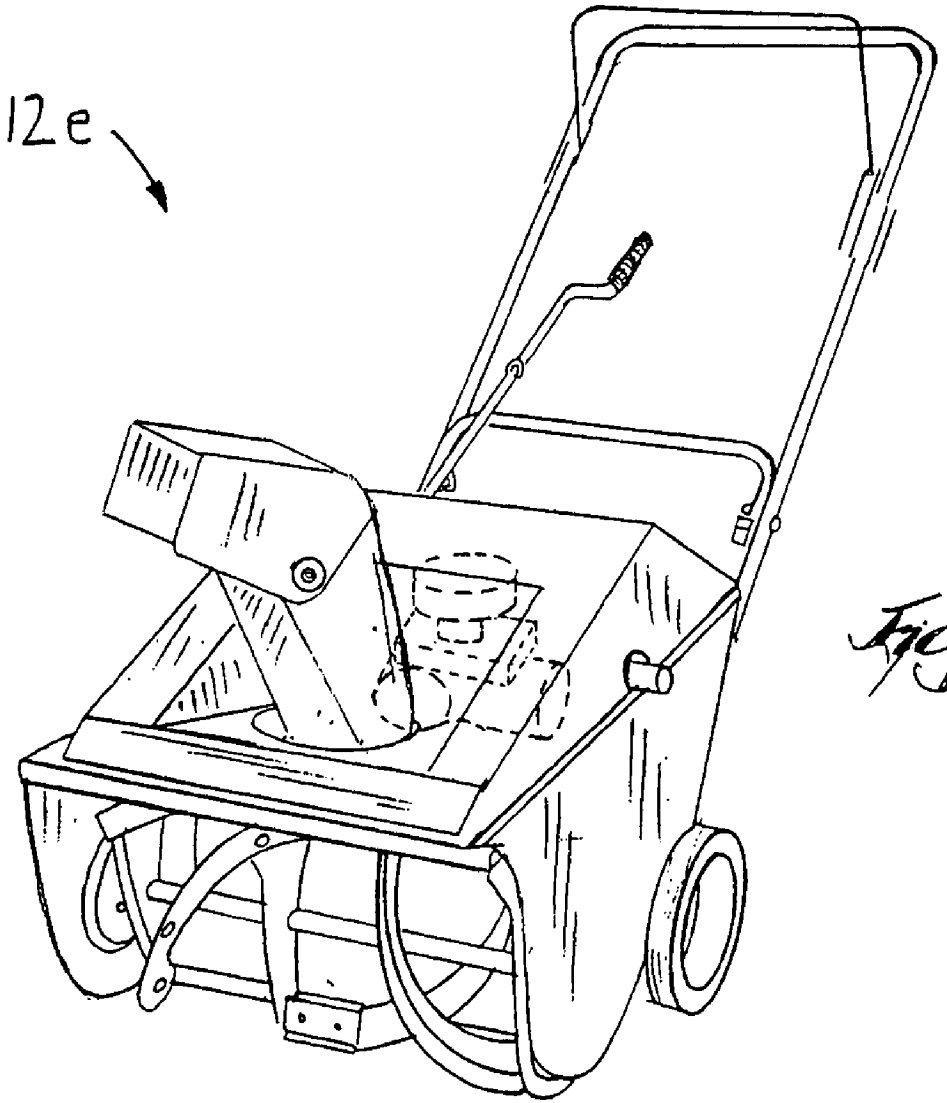
FIG. 12 is a snowthrower having an internal combustion engine embodying the invention.
Figure 13:
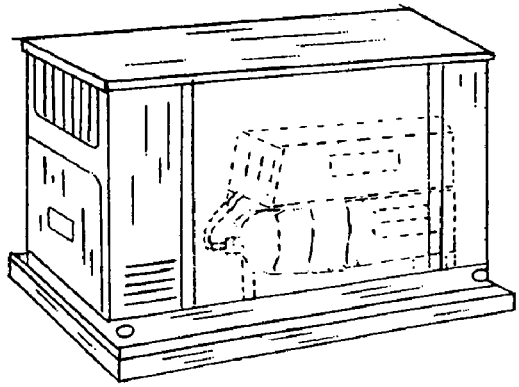
FIG. 13 is an automatic backup power system having an internal combustion engine embodying the invention.
Figure 14:
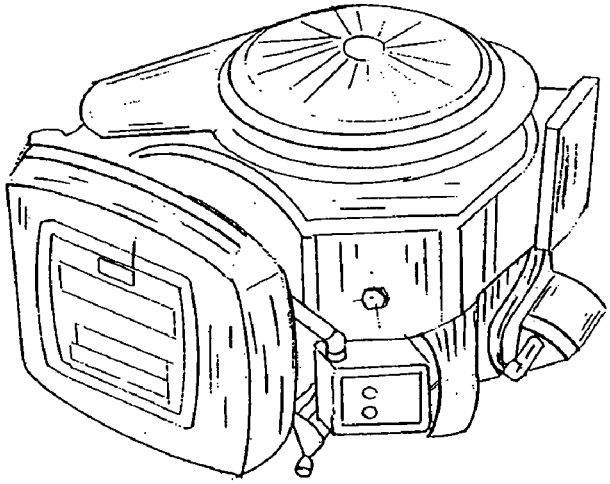
FIG. 14 is a multi-cylinder, V-twin internal combustion engine embodying the invention.
Figure 15:
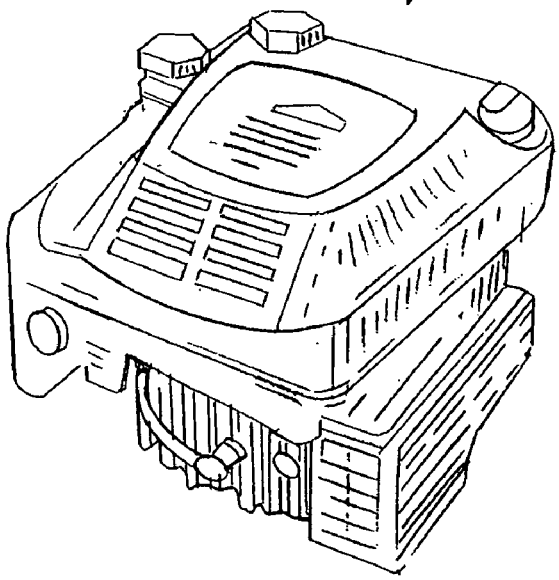
FIG. 15 is a single cylinder internal combustion engine embodying the invention.

FIG. 1 schematically illustrates a vapor control system 10 for use with a device 12 having an internal combustion engine 14. In FIG. 1, the system 10 is illustrated as configured for use in a walk-behind type lawn mower 12*a* (see FIG. 9), but could alternatively be a riding lawnmower 12*b* (See FIG. 8), a portable generator 12*c* (see FIG. 10), a pump, such as the type commonly used in a portable pressure washer 12*d* (see FIG. 11), a snowthrower 12*e* (see FIG. 12), a stand-alone generator, such as the type commonly used for an automatic backup power system 12*f* (see FIG. 13), or the like. The engine 14 can be a multi-cylinder engine, such as a V-twin or opposed-cylinder engine 14*a* (see FIG. 14), or a single-cylinder engine 14*b* (see FIG. 15).

The system 10 includes an engine intake assembly 16, a fuel tank assembly 18, an evaporative emission control device 22, and an engine control device 26. The intake assembly 16 fluidly communicates with the control device 22 through a vapor line 30, and the fuel tank assembly 18 fluidly communicates with the control device 22 through a vent line 34. All of the above components are mounted to or otherwise carried by the device 12.

The engine intake assembly 16 conveys intake air from the atmosphere toward an engine combustion chamber 38. As the air travels through the intake assembly 16, combustible fuel is mixed with the air to form an air/fuel mixture or charge. The charge is then delivered to the combustion chamber 38 where it is ignited, expands, and is subsequently discharged from the combustion chamber 38 through an engine exhaust system (not shown). The engine intake assembly 16 includes an air filter element 40, an evaporative valve 42 downstream of the filter element 40, a purge tube 46 downstream of the valve 42 and coupled to the vapor line 30, and a venturi section 50 downstream of the purge tube 46. Some embodiments of the engine intake assembly 16 may be configured for operation without the evaporative valve 42. The venturi section 50 includes an aperture 54 that communicates with a carburetor 58. The carburetor 58 receives fuel from the fuel tank assembly 18 via a fuel line 60 and regulates the delivery of the fuel to the intake assembly 16 as is well known in the art. A throttle valve 62 is located downstream of the venturi section 50 and regulates the delivery of the air/fuel mixture to the combustion chamber 38.

The fuel tank assembly 18 includes a fuel tank 66 having a filler opening 70 that is covered by a removable, sealed filler cap 74. The fuel tank 66 also includes a vent opening 78 coupled to the vent line 34 and including a rollover check valve 82 and/or a liquid vapor separator. Liquid fuel 86 such as gasoline is stored in the fuel tank 66 and flows toward the carburetor 58 along the fuel line 60. The check valve 82 substantially prevents the liquid fuel 86 from flowing through the vent line 34 should the fuel tank 66 become overturned.

The control device 22 includes a first opening 90 communicating with the vent line 34, a second opening 94 communicating with the vapor line 30, and a third opening 98 communicating with the atmosphere. The control device 22 contains a mass of activated carbon 102 or any other suitable composition that is able to store (e.g. through adsorption) fuel vapor as described further below. The engine control device 26 is operatively coupled to the valve 42 by a mechanical linkage 104 (shown only schematically in the Figures) such that, when the engine 14 is running, the valve 42 is in an open position (shown in phantom in FIG. 1), and when the engine 14 is not running, the valve 42 is in a closed position (shown in solid lines in FIG. 1). As illustrated in FIG. 1, the engine control device 26 takes the form of an operator bail 106 of a lawnmower 12*a* (see FIG. 9). In alternative embodiments, the engine control device 26 may include an air vane of a mechanical governor (not shown) of the engine 14. Various other configurations of the engine control device 26 are also possible, provided they operate substantially as described above. Preferably, the engine control device 26 is operator or mechanically actuated, thereby reducing the cost and complexity associated with the addition of electronically or microprocessor controlled components.

The vapor control system 10 is configured to reduce engine emissions that are associated with the evaporation of the liquid fuel 86 that is stored in the fuel tank 66 and that remains in the carburetor 58 when the engine 14 is not running. When the device 14 is not in use, some of the liquid fuel 86 in the fuel tank 66 may evaporate, releasing fuel vapors into the empty space of the tank 66. To control the emission of fuel vapors, the vapors are carried out of the fuel tank 66 toward the evaporative emission control device 22 along the vent line 34. Once the fuel vapors reach the control device 22, the vapor is adsorbed by the activated carbon 102 such that air emitted from the control device 22 to the atmosphere via the third opening 98 contains a reduced amount of fuel vapor.

Fuel vapors from the liquid fuel 86 remaining in the carburetor when the device 12 is not in use are also conducted to the control device 22. As described above, when the engine 14 is not running, the evaporative valve 42 is in the closed position such that fuel vapor cannot travel upstream along the engine intake assembly 16 and out the filter element 40 to the atmosphere. Fuel vapors are essentially trapped between the valve 42 and the throttle valve 62, such that they must travel along the vapor line 30 toward the control device 22 when the engine 14 is not running. These vapors are adsorbed by the activated carbon 102 in the same manner as the fuel vapors resulting from evaporation of the liquid fuel 86 in the fuel tank 66.

As the device 12 is subjected to extended periods of non-use, the carbon 102 in the control device 22 becomes saturated with fuel vapors. As a result, it is necessary to "purge" or remove the vapors from the carbon. This purging occurs while the device 12 is in use and the engine 14 is running. When the engine 14 is started, the engine control device 26 opens the valve 42 such that intake air can enter the venturi section 50. As the engine 14 runs, atmospheric air is drawn through the intake assembly toward the combustion chamber. As the air passes through the intake assembly 16 it flows over the purge tube 46, thereby creating a vacuum in the vapor line 30. In response to the formation of the vacuum in the vapor line 30, atmospheric air is drawn into the control device 22 through the third opening 98. The atmospheric air then removes fuel vapor from the activated carbon 102 and continues along the vapor line 30 toward the purge tube 46. The vapor-laden air then mixes with the intake air and is subsequently delivered to the combustion chamber 38 for ignition.

The embodiment of the invention illustrated in FIG. 1 is configured such that as the speed of the engine 14 is increased, the rate at which the activated carbon 102 is purged also increases. Specifically, as the engine's speed is increased, the velocity of the intake air in the vicinity of the purge tube 46 also increases, which in turn increases the vacuum in the vapor line 30. The pressure drop that occurs as atmospheric air is drawn across the air filter element 40 also increases the vacuum in the vapor line 30. A greater vacuum in the vapor line 30 causes a greater amount of atmospheric air to flow through the control device 22, resulting in increased purging of the activated carbon 102. Furthermore, at higher engine speeds, a greater amount of fuel is supplied to the intake air by the carburetor 58. As such, the additional fuel introduced to the intake air in the form of fuel vapor flowing from the purge tube 46 is a relatively low percentage of the total amount of fuel in the final air/fuel mixture that is delivered to the combustion chamber 38. This configuration provides a consistent and predictable air/fuel mixture during engine 14 operation.

Figure 2:
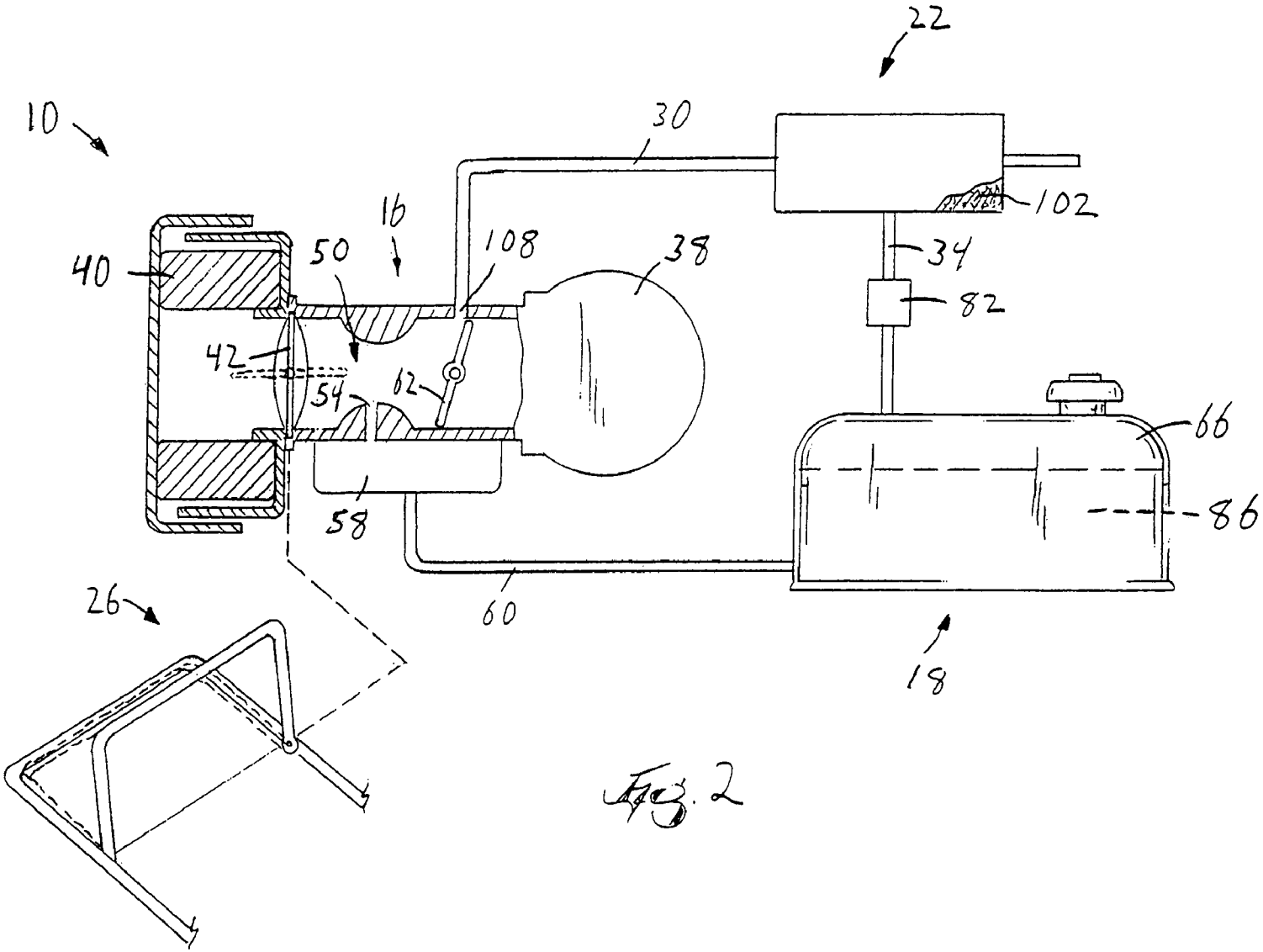
FIG. 2 is a schematic view of another internal-combustion-engine-powered device having a fuel vapor control system embodying the invention.

Referring now to FIG. 2, an alternative embodiment of the invention is illustrated wherein like parts have been given like reference numerals. The vapor control system 10 illustrated in FIG. 2 is similar to that illustrated in FIG. 1 and includes an engine intake assembly 16, a fuel tank assembly 18, an evaporative emission control device 22, and an engine control device 26. However in contrast to the system 10 of FIG. 1, the system 10 of FIG. 2 is configured such that the control device 22 is purged primarily during low speed operation of the engine 14 as described further below.

As illustrated in FIG. 2, the engine intake assembly 16 includes an aperture 108 that communicates with the vapor line 30. The aperture 108 is positioned such that it is substantially aligned with the throttle valve 62. As a result, when the throttle valve 62 is in a closed position (e.g. when engine speed is lowest), the velocity of the intake air passing over the aperture 108 is at a maximum due to the relatively small opening (e.g. cross-sectional area) through which the intake air travels. As described above with respect to the purge tube 46, high velocity intake air moving past the aperture 108 creates a vacuum in the vapor line 30 that results in the purging of the control device 22. When the throttle valve 62 is opened, the velocity of the intake passing over the aperture 108 is reduced due to the larger opening (e.g. cross-sectional area) through which the intake air travels resulting in a reduction of flow velocity near the walls of the intake assembly 16. Lower velocity air traveling over the aperture 108 results in a weaker vacuum in the vapor line 30 and less purging of the control device 22.

Figure 3:
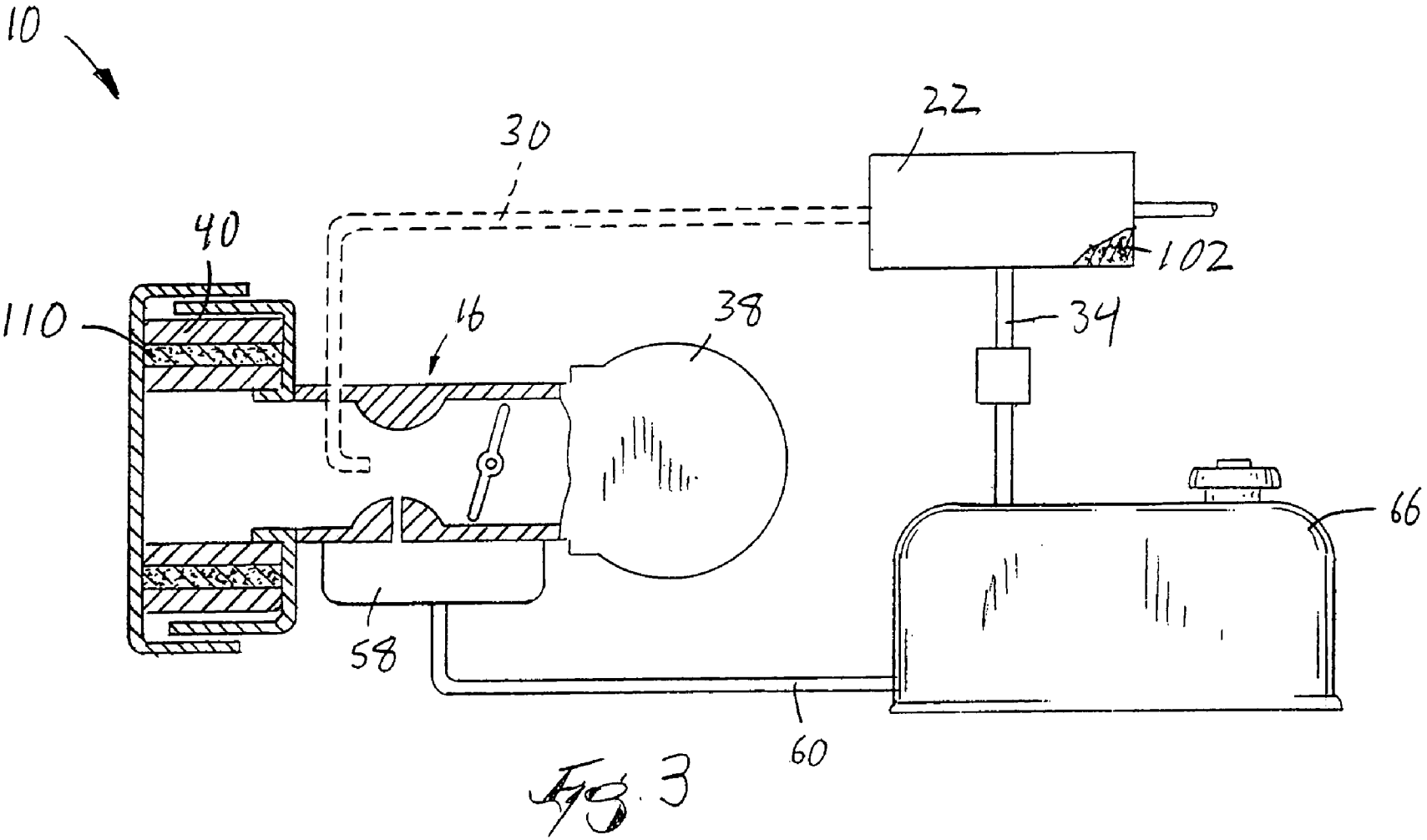
FIG. 3 is a schematic view of another internal-combustion-engine-powered device having a fuel vapor control system embodying the invention.
Figure 4:
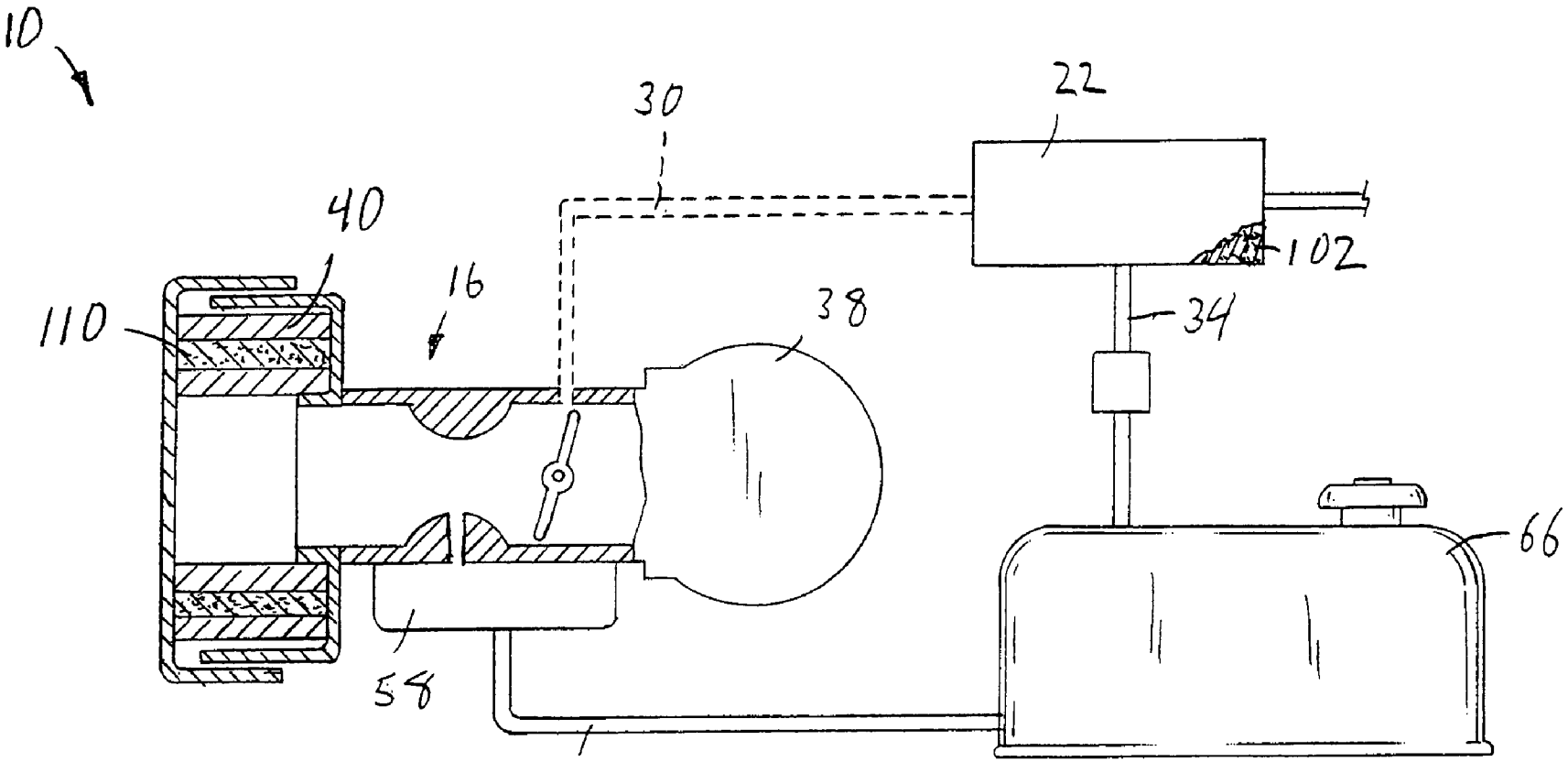
FIG. 4 is a schematic view of another internal-combustion-engine-powered device having a fuel vapor control system embodying the invention.

FIGS. 3 and 4 illustrate a further alternate vapor control system 10 including an additional mass of activated carbon 110 embedded in the filter element 40. As a result, the system 10 illustrated in FIGS. 3 and 4 does not require an evaporative valve 42 as described further below. The system 10 may be configured such that the control device 22 is primarily purged in a manner similar to the system 10 of FIG. 1, (e.g. at high engine speeds, see FIG. 3) or in a manner similar to the system 10 of FIG. 2, (e.g. at low engine speeds, see FIG. 4).

The additional mass of activated carbon 110 embedded in the filter element 40 substantially stores (e.g. through adsorption) fuel vapors that are produced by liquid fuel remaining in the carburetor 58 when the device 12 is not in use. Conversely, when the device 12 is in use, atmospheric air is drawn through the filter element 40 and the activated carbon 110. Fuel vapors stored in the carbon 110 are released to the intake air and continue through the engine intake assembly 16 toward the combustion chamber 38. Although the illustrated additional mass of activated carbon 110 is embedded within the filter element 40, the carbon 110 may also be located at other positions along the intake assembly 16 between the filter element 40 and the purge tube 46, as long as substantially all of the intake air passes through the carbon 110 before reaching the purge tube 46. Because the additional mass of activated carbon 110 embedded in the air filter 40 primarily adsorbs vapors from the relatively small quantity of liquid fuel that remains in the carburetor 58 after engine 14 shutdown, the additional mass of carbon 110 will generally be smaller than the mass of carbon 102 contained in the control device 22. However in certain devices 12 with relatively small fuel tanks 66, the additional mass of carbon 110 may be approximately equal to the mass of carbon 102 contained in the control device 22.

Figure 5:
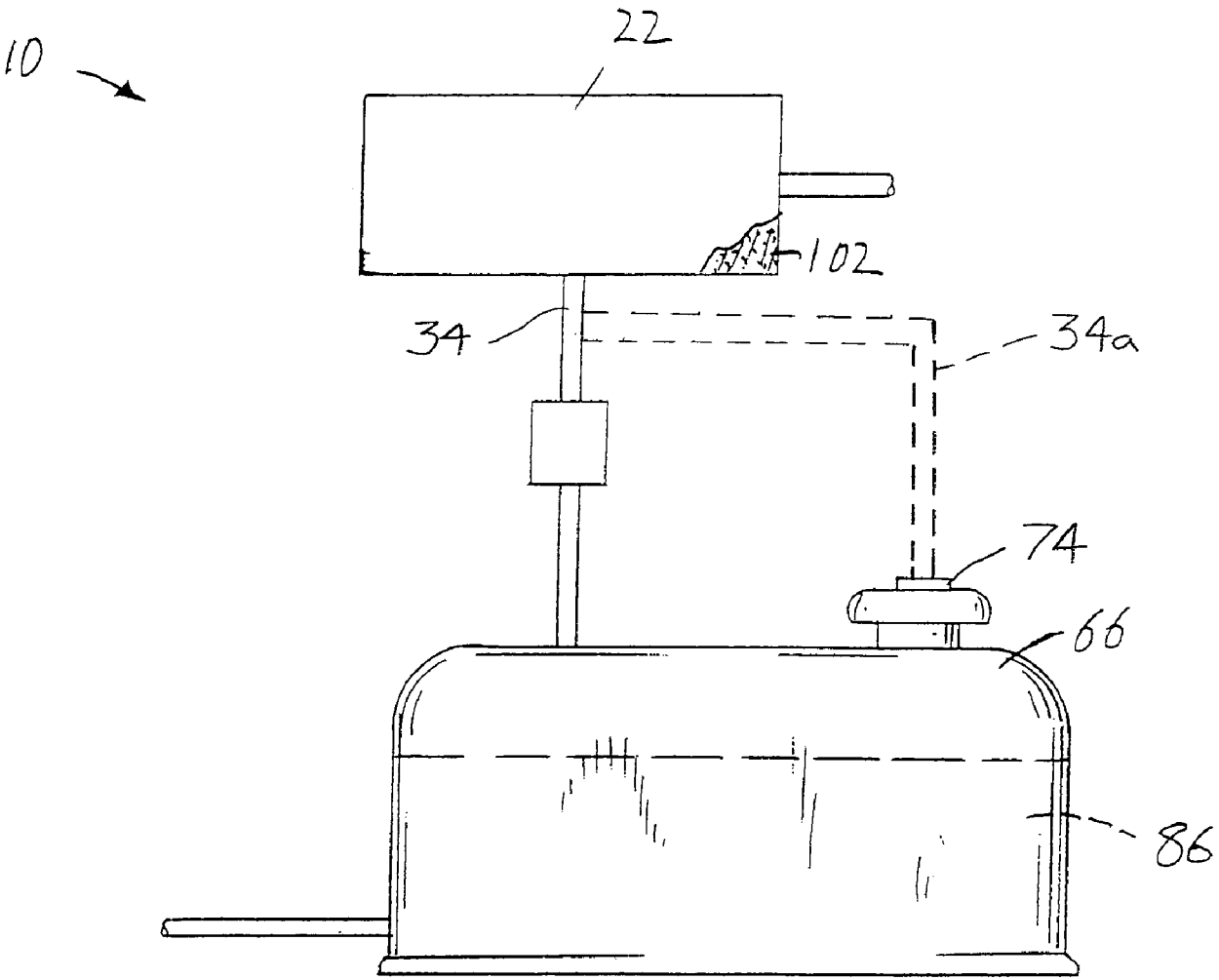
FIG. 5 is a schematic view of a fuel tank venting system embodying the invention.

A further embodiment of the invention is illustrated in FIG. 5. The system 10 of FIG. 5 is specifically sized and configured such that the vapor line 30 is unnecessary. The system of FIG. 5 is "passively purged" as described further below such that the fuel tank 66, the vent line 34 and the evaporative control device 22 cooperate to store (e.g. through adsorption) fuel vapors resulting from the evaporation of the liquid fuel in the fuel tank 66, and to purge the control device 22 by drawing atmospheric air through the control device 22. Specifically, as the various components begin to heat up, (e.g. during engine running or increased ambient temperatures) the gasses and vapors in the fuel tank 66 expand and are vented through the vent line 34 to the control device 22 where the vapors are subsequently adsorbed by the activated carbon 102. As the components cool down (e.g. when the engine is stopped or the ambient temperature decreases) or when the fuel 86 level drops, atmospheric air is drawn into the control device 22 and through the carbon 102, thereby purging the vapors from the carbon 102 and returning them to the fuel tank 66. In addition, the system of FIG. 5 illustrates an alternative vent line 34*a* or passage connected to a fuel fill cap 74.

Figure 6:
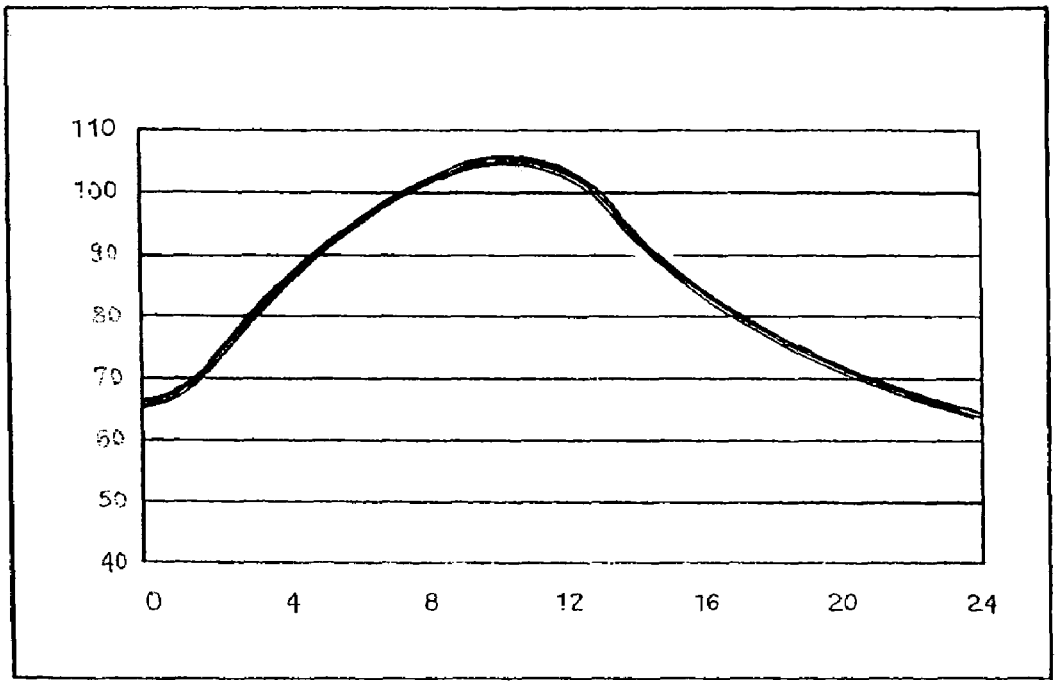
FIG. 6 is a graphical representation of a diurnal cycle for a vapor control system.

FIG. 6 illustrates a diurnal test cycle of 24 hours that is used to determine whether the present invention is capable of controlling evaporative emissions during a hypothetical summer day. FIG. 6 depicts the hypothetical ambient temperatures to which an evaporative emission control system may be subjected. The temperatures range from an overnight temperature of approximately 65° F., up to a mid-day temperature of about 105° F., followed by a return to approximately 65° F. Other test temperatures are possible depending on the specific environment and the type of use the system 10 is to be subjected to.

Figure 7:
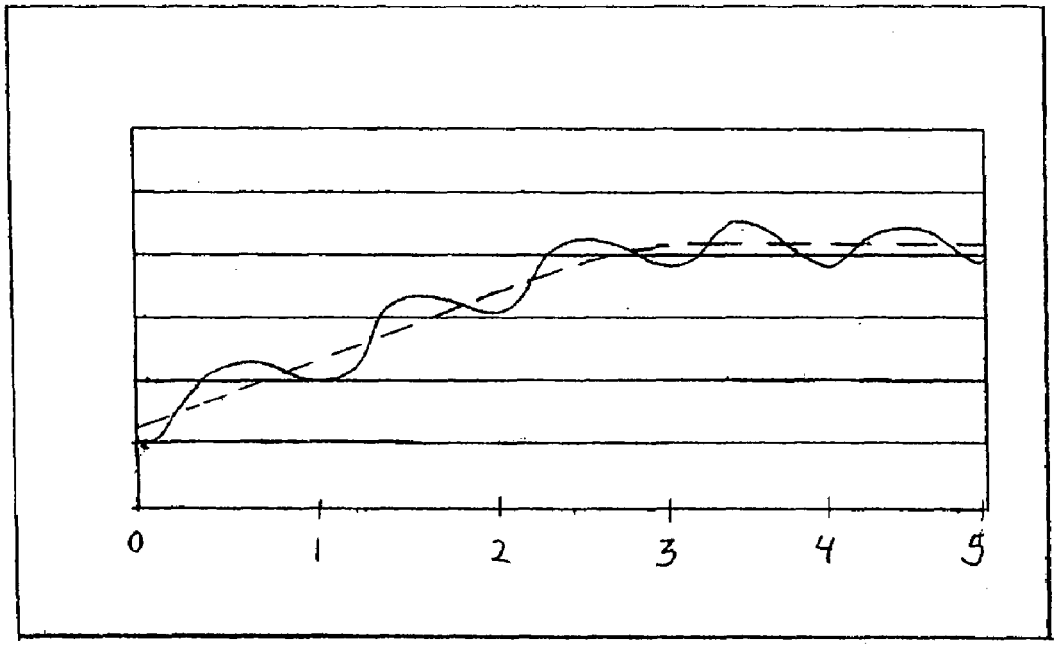
FIG. 7 is a graphical representation of the mass of a vapor control device subjected to several diurnal cycles.

FIG. 7 illustrates the performance of a hypothetical vapor control system operating over a period of several diurnals. The figure illustrates the mass of the evaporative control device 22 along the ordinate, and the number of diurnal cycles along the abscissa. As illustrated, the control device 22 is initially at a "dry mass" associated with a relatively low amount of fuel vapor stored within the carbon 102. As the diurnal cycle begins and the ambient temperature increases, some of the liquid fuel 86 stored in the fuel tank 66 begins to evaporate and the fuel vapors begin to expand. This expansion forces the vapors out of the tank 66 via the vapor line 34 and into the control device 22. As the fuel continues to evaporate and expand, the mass of the control device 22 begins to increase as the carbon 102 adsorbs fuel vapors. As the ambient temperature begins to decrease near the latter portion of an individual diurnal cycle, the liquid fuel and the fuel vapors begin to cool, such that a portion of the vapors begin to contract and/or condense into liquid fuel, thereby forming a vacuum in the fuel tank 66. Atmospheric air is drawn into the control device 22 and through the activated carbon 102 to fill the vacuum in the fuel tank 66, thus purging the fuel vapors from the carbon 102 as discussed above. As the fuel vapors are purged from the device 22, the mass of the device 22 decreases.

It is believed that over the course of several diurnal periods, the average mass of the device 22 (illustrated by the dashed line in FIG. 7) will increase until the average mass of the device 22 reaches an equilibrium value (e.g. after about 3 diurnals as illustrated in FIG. 7). Preferably the equilibrium mass value is achieved before the control device 22 reaches a completely saturated condition to control the release of fuel vapors into the atmosphere. While operating in this equilibrium regime, the device 22 captures at least a portion of the fuel vapors emitted during the first portion of the diurnal period (e.g. during ambient temperature increase), stores the vapors, and then returns the vapors to the fuel tank 66 during the latter portion of the diurnal period (e.g. during ambient temperature decrease).

A hypothetical system that is designed to operate substantially as described above will theoretically maintain the equilibrium mass value for an extended period of time (e.g. 30 days or more) without requiring any form of active purging. The specific number of diurnals required to reach equilibrium conditions, as well as the level of vapor control during the equilibrium period will vary based upon the specific system design parameters. Such a system would presumably provide effective vapor control during extended periods of non-use that are commonly associated with the devices 12 illustrated in FIGS. 8–13, as well as additional devices. Various active purge methods such as those described above may also be utilized to provide additional purging of the control device 22.

What is claimed is:

1. A stationary fuel storage system comprising:

a stationary fuel tank defining a tank volume adapted to store a quantity of fuel, the stationary fuel tank not capable of being readily moved;

an evaporative emission device disposed outside of the tank volume and defining a device volume that is in fluid communication with the atmosphere;

a mass of fuel vapor adsorbing material disposed within the device volume; and a vent conduit providing fluid communication between the fuel tank and the evaporative emission device.

2. The stationary fuel storage system of claim 1, wherein the vent conduit enables a how of fuel vapor from the fuel tank to the evaporative emission device.

3. The stationary fuel storage system of claim 2, wherein the flow from the fuel tank includes fuel vapor, and wherein a substantial portion of the fuel vapor is adsorbed by the mass of fuel vapor adsorbing material.

4. The stationary fuel storage system of claim 1, wherein the fuel tank includes a tiller cap, and wherein the vent conduit is coupled to the filler cap.

5. The stationary fuel storage system of claim 1, wherein the evaporative emission device is in direct fluid communication with only the atmosphere and the fuel tank.

6. The stationary fuel storage system of claim 1, wherein an increase in ambient temperature increases pressure within the fuel tank, and wherein in response to the increase in pressure within the fuel tank, air and fuel vapor flow through the vent conduit and into the evaporative emission device, the fuel vapor is adsorbed by the fuel vapor adsorbing material, and the air exits the evaporative emission device to the atmosphere.

7. A stationary evaporative emission control system comprising:

an evaporative emission device including a mass of fuel vapor adsorbing material;

a stationary fuel tank having a tank volume;

an atmospheric vent providing fluid communication between the evaporative emission device and the atmosphere; and a vent conduit providing fluid communication between the fuel tank and the evaporative emission device, the vent conduit enabling flow from the fuel tank to the evaporative emission device in response to an increase in pressure within the fuel tank, and enabling flow from the evaporative emission device to the fuel tank in response to a decrease in pressure within the fuel tank, wherein the device volume and the tank volume are sized relative to one another, and wherein a portion of fuel vapor passing from the evaporative emission device to the atmosphere is substantially reduced, and wherein fuel vapor is able to only travel between the evaporative emission device and the atmosphere and between the evaporative emission device and the fuel tank.

8. The stationary evaporative emission control system of claim 7, wherein the fuel lank includes a filler cap, and wherein the vent conduit is coupled to the filler cap.

9. The stationary evaporative emission control system of claim 7, wherein an increase iii ambient temperature increases pressure within the fuel tank, and wherein in response to the increase in pressure within the fuel tank, fuel vapor flows through the vent conduit and into the evaporative emission device, the fuel vapor is adsorbed by the fuel vapor adsorbing material.

10. The stationary evaporative emission control system of claim 7, wherein the how from the fuel tank includes a fuel vapor portion, and wherein the fuel vapor portion is substantially adsorbed by the mass of fuel vapor adsorbing material.

11. The stationary evaporative emission control system of claim 7, wherein the evaporative emission device is in direct fluid communication with only the atmosphere and the fuel tank.

12. The stationary evaporative emission control system of claim 7, wherein the evaporative emission device is disposed outside of the tank volume.

13. The stationary evaporative emission control system of claim 7, wherein the device volume and the tank volume are sized relative to one another such that substantially no fuel vapor passes from the evaporative emission device to the atmosphere.

14. A stationary fuel storage system comprising:

a stationary fuel tank defining a tank volume adapted to store a quantity of fuel;

a passive evaporative emission device;

a first flow path providing fluid communication between the passive evaporative emission device and the atmosphere;

a mass of fuel vapor adsorbing material disposed within the device volume; and a vent conduit providing fluid communication between the fuel tank and the evaporative emission device such that fuel vapor is able to flow between the tank and the evaporative emission device, wherein the first flow path and the vent conduit define the only flow paths into or out of the evaporative emission device.

15. The stationary fuel storage system of claim 14, wherein the first flow path and the vent conduit define the only flow paths into or out of the evaporative emission device during all operating conditions.

16. The stationary fuel storage system of claim 14, wherein the vent conduit enables flow from the fuel tank to the evaporative emission device in response to an increase in pressure within the fuel tank, and enables flow from the evaporative emission device to the fuel tank in response to a decrease in pressure within the fuel tank.

17. The stationary fuel storage system of claim 16, wherein the flow from the fuel tank includes a fuel vapor portion, and wherein the fuel vapor portion is substantially adsorbed by the mass of fuel vapor adsorbing material.

18. The stationary fuel storage system of claim 17, wherein the device volume and the tank volume are sized relative to one another such that a portion of fuel vapor passing from the evaporative emission device to the atmosphere is substantially reduced.

19. The stationary fuel storage system of claim 14, wherein the fuel tank includes a filler cap, and wherein the vent conduit is coupled to the filler cap.

20. The stationary fuel storage system of claim 14, wherein the passive evaporative emission device is disposed outside of the tank volume.

21. A fuel storage system comprising:

a fuel tank defining a tank volume adapted to store a quantity of fuel;

an evaporative emission device defining a device volume; and a vent aperture providing fluid communication between the fuel tank and the evaporative emission device, wherein the evaporative emission device is in direct fluid communication with only the atmosphere and the fuel tank during all operating conditions.

22. The fuel storage system of claim 21, wherein the evaporative emission device is disposed outside of the tank volume.

23. The fuel storage system of claim 21, further comprising a mass of fuel vapor adsorbing material disposed within the device volume.

24. The fuel storage system of claim 21, wherein the vent aperture includes a vent conduit that interconnects the fuel tank and the evaporative emission device.

* * * * *